US011448097B1

(12) United States Patent
Lefebvre

(10) Patent No.: US 11,448,097 B1
(45) Date of Patent: Sep. 20, 2022

(54) TURBINE EXHAUST STRUT INTERNAL CORE STRUCTURE

(71) Applicant: PRATT & WHITNEY CANADA CORP., Longueuil (CA)

(72) Inventor: Guy Lefebvre, St-Bruno-de-Montarville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/331,736

(22) Filed: May 27, 2021

(51) Int. Cl.
*F01D 25/30* (2006.01)
*F01D 9/04* (2006.01)
*F01D 25/24* (2006.01)

(52) U.S. Cl.
CPC ..... *F01D 25/30* (2013.01); *F01D 9/047* (2013.01); *F01D 25/246* (2013.01); *F05D 2240/14* (2013.01)

(58) Field of Classification Search
CPC . F01D 25/30; F01D 9/04; F01D 9/041; F04D 29/30; F04D 29/24; F04D 29/242; F05D 2260/94; F05D 2260/941; F05D 2240/10; F05D 2240/121; F05D 2240/122
See application file for complete search history.

(56) References Cited

U.S. PATENT DOCUMENTS

| | | | | |
|---|---|---|---|---|
| 5,746,574 | A * | 5/1998 | Czachor | F01D 5/189 285/368 |
| 7,891,165 | B2 | 2/2011 | Bader et al. | |
| 9,970,320 | B2 | 5/2018 | De Sousa et al. | |
| 10,227,895 | B2 * | 3/2019 | Farah | F01D 25/24 |
| 10,329,956 | B2 * | 6/2019 | Scott | F01D 9/065 |
| 2017/0067369 | A1 * | 3/2017 | Hashimoto | F02C 3/04 |
| 2020/0240292 | A1 | 7/2020 | Stromberg et al. | |

* cited by examiner

*Primary Examiner* — Christopher Verdier
*Assistant Examiner* — Maxime M Adjagbe
(74) *Attorney, Agent, or Firm* — Norton Rose Fulbright Canada LLP.

(57) ABSTRACT

A turbine exhaust case (TEC) includes an outer case, an inner case, and a plurality of struts structurally connecting the inner case to the outer case. At least one of the struts has an airfoil body with a hollow core. A leading edge stiffener is provided at the radially inner end of the airfoil body. The leading edge stiffener projects into the hollow core and merges with a stiffener ring projecting from a radially inner surface of the inner case.

18 Claims, 4 Drawing Sheets

TURBINE EXHAUST STRUT INTERNAL CORE STRUCTURE

TECHNICAL FIELD

The application relates generally to aircraft engines and, more particularly, to turbine exhaust struts.

BACKGROUND OF THE ART

Various factors exert pressures on turbine engine manufacturers to continually improve their designs. Design improvements take many factors into consideration, such as weight, structural optimization, durability, production costs, etc. Accordingly, while known turbine exhaust cases were satisfactory to a certain extent, there remained room for improvement.

SUMMARY

In one aspect, there is provided a turbine exhaust case (TEC) comprising: an outer case; an inner case; an annular exhaust gas path between the outer case and the inner case; and a plurality of struts extending across the annular gas path and structurally connecting the inner case to the outer case, at least one of the plurality of struts having an airfoil body with a hollow core, the airfoil body having opposed sides extending chordwise from a leading edge to a trailing edge and spanwise from a radially inner end to a radially outer end; wherein the at least one of the plurality of struts has a leading edge stiffener at the radially inner end thereof, the leading edge stiffener projecting into the hollow core and merging with a stiffener ring projecting from a radially inner surface of the inner case.

In another aspect, there is provided a TEC comprising: an outer case extending around a central axis; an inner case concentrically disposed inside the outer case, the inner case having a radially inner surface and a stiffener ring projecting from the radially inner surface; an annular exhaust gas path between the outer case and the inner case; and a plurality of struts extending across the annular exhaust path and structurally connecting the inner case to the outer case, the plurality of struts including at least one strut having an airfoil body with a hollow core, the airfoil body having opposed pressure and suction sides extending from a leading edge to a trailing edge, the at least one of the plurality of struts locally reinforced along a radially inner end portion of the leading edge by a leading edge stiffener projecting into the hollow core and merging with the stiffener ring on the radially inner surface of the inner case.

In a further aspect, there is provided a TEC comprising: an outer case extending around a central axis; an inner case concentrically disposed inside the outer case, the inner case having a radially inner surface and a stiffener ring projecting from the radially inner surface; and a plurality of struts connecting the inner case to the outer case, each strut of the plurality of struts including: a hollow airfoil body having opposed sides extending chordwise from a leading edge to a trailing edge, and a leading edge stiffener inside the hollow airfoil body at a junction of the leading edge and the inner case, the leading edge stiffener merging with the stiffener ring on the radially inner surface of the inner case.

DESCRIPTION OF THE DRAWINGS

Reference is now made to the accompanying figures in which.

DETAILED DESCRIPTION

Figure 1:
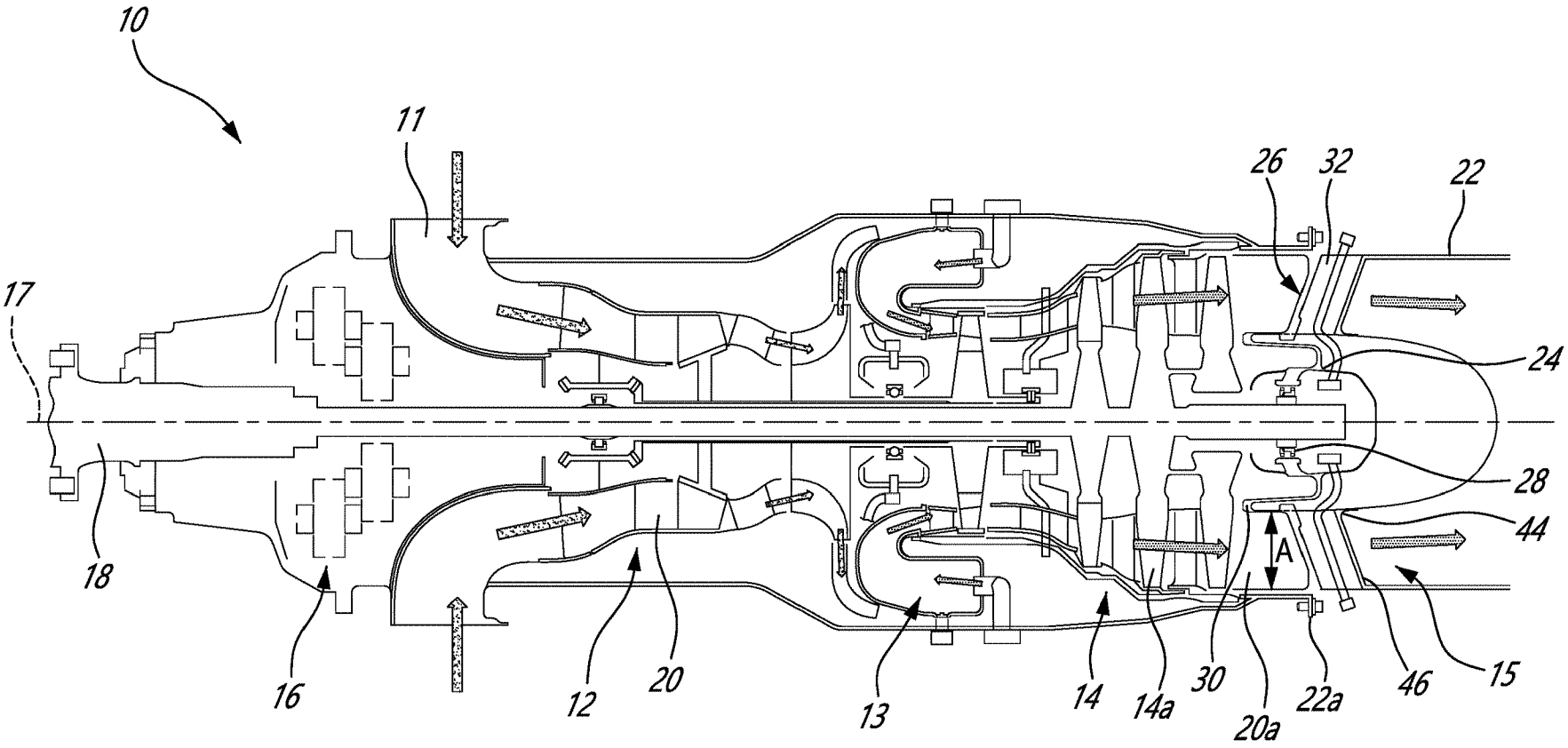
FIG. 1 is a schematic cross-sectional view of a turboprop gas turbine engine.

FIG. 1 illustrates an aircraft engine of a type preferably provided for use in subsonic flight, and generally comprising in serial flow communication an air inlet 11, a compressor 12 for pressurizing the air from the air inlet 11, a combustor 13 in which the compressed air is mixed with fuel and ignited for generating an annular stream of hot combustion gases, a turbine 14 for extracting energy from the combustion gases, and a turbine exhaust case (TEC) 15 through which the combustion gases exit the engine 10. The turbine 14 includes a low pressure (LP) or power turbine 14*a* drivingly connected to an input end of a reduction gearbox (RGB) 16. The RGB 16 has an output end drivingly connected to an output shaft 18 configured to drive a rotatable load (not shown). For instance, the rotatable load can take the form of a propeller or a rotor, such as a helicopter main rotor. The engine 10 has an engine centerline 17. According to the illustrated embodiment, the compressor and the turbine rotors are mounted in-line for rotation about the engine centerline 17.

Figure 7:
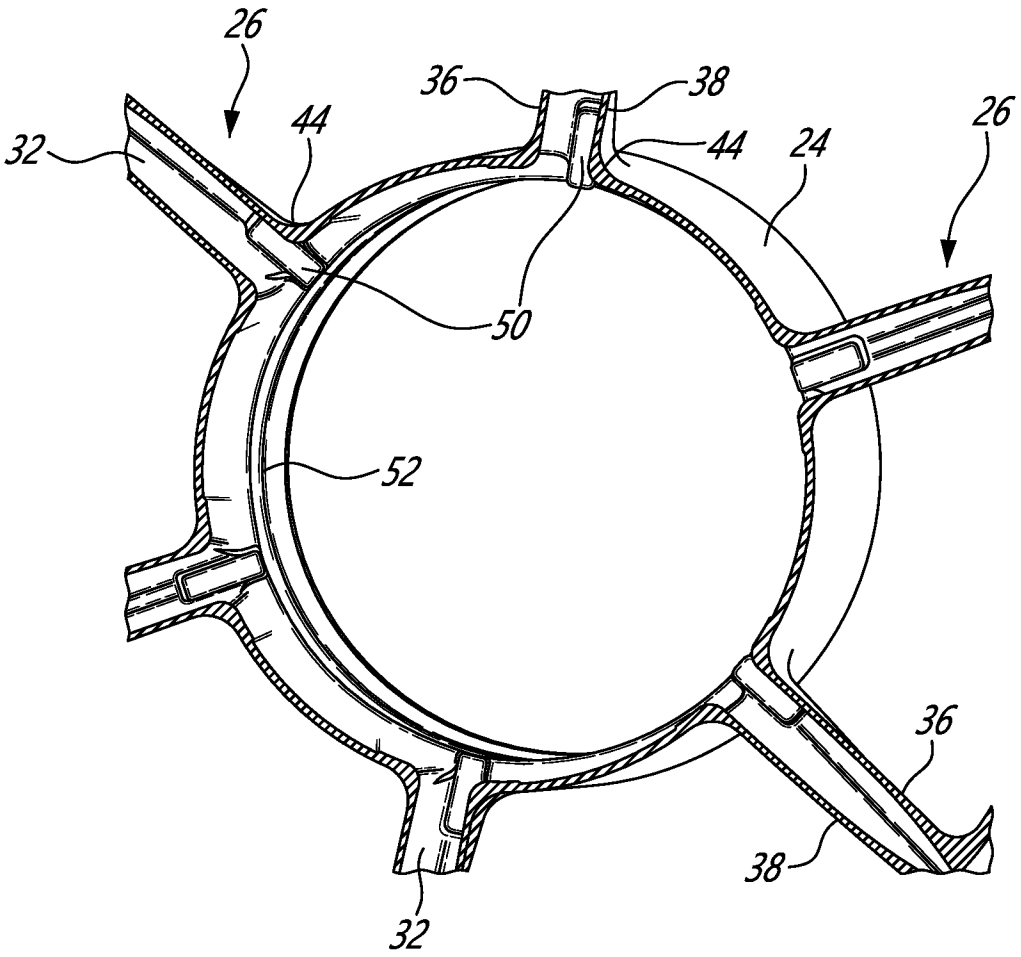
FIG. 7 a cross-section illustrating the strut reinforcement core structures of the struts at the junction of the strut leading edge and the TEC inner ring.

According to the embodiment shown in FIG. 1, the TEC 15 terminates the core gas path 20 of the engine. The TEC 15 is disposed immediately downstream of the last stage of the low pressure turbine 14*a* for receiving hot gases therefrom and exhausting the hot gases to the atmosphere. The TEC 15 comprises an outer case 22 having a radially inner surface forming a radially outer delimitation (i.e. outer gas path wall) of an annular exhaust path 20*a* of the core gas path 20, an inner case 24 having a radially outer wall forming a radially inner delimitation (i.e. inner gas path wall) of the annular exhaust path 20*a* of the core gas path 20, and a plurality of turbine exhaust struts 26 (e.g. 6 struts in the embodiment shown in FIG. 7) extending generally radially across the annular exhaust path 20*a*. As shown in FIG. 7, the struts 26 are circumferentially interspaced from one another. The outer and inner cases 22, 24 are provided in the form of outer and inner structural rings concentrically mounted about the engine centerline 17. According to some embodiments, the outer case 22 may be bolted or otherwise suitably mounted to the downstream end of the turbine case via a flange connection. For instance, as exemplified in FIG. 1, the outer case 22 can have an outer flange 22*a* bolted to a corresponding flange at the downstream end of the turbine case. The struts 26 structurally connect the inner case 24 to the outer case 22. According to the illustrated embodiment, the inner case 24 is configured to support a bearing 28 of the low pressure turbine spool via a hairpin connection 30 or the like. The struts 26 provide a load path for transferring loads from the inner case 24 (and thus the bearing 28) to the outer case 22. According to some embodiments, the outer case 22, the inner case 24 and the struts 26 are of unitary construction. For instance, the outer case 22, the inner case 24 and the struts 26 can be integrally formed as a monolithic cast component.

Figure 3:
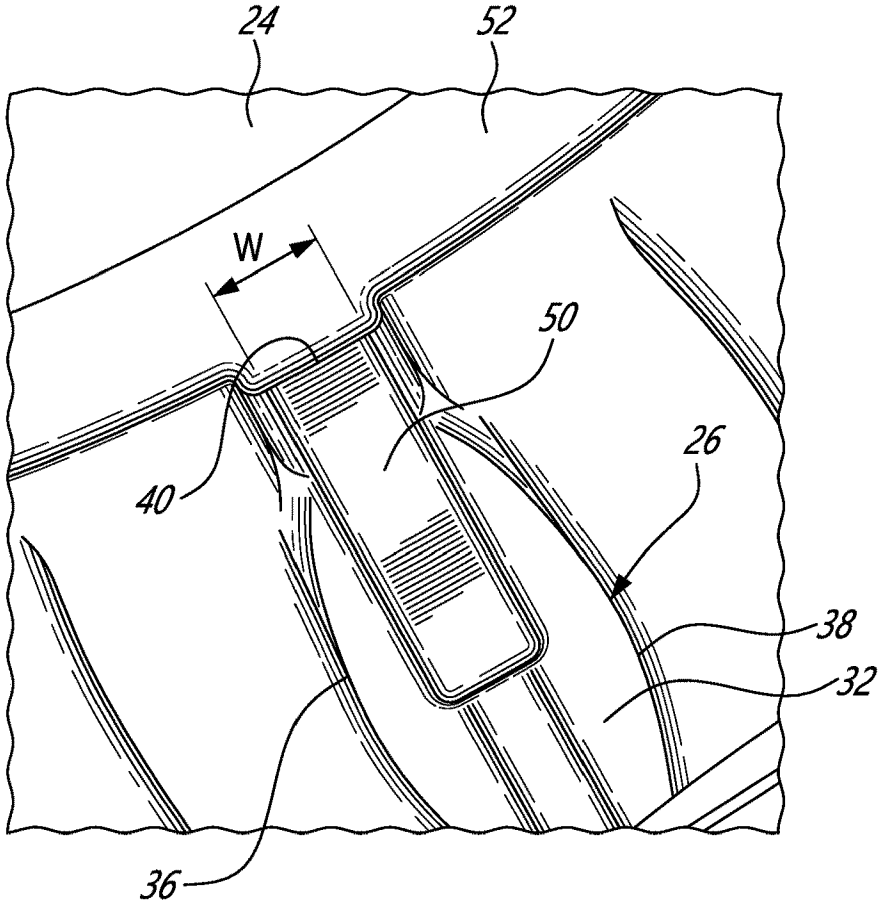
FIG. 3 is an isometric view from within an inner structural ring of the TEC and illustrating a reinforcement core structure of the exhaust strut at a leading edge junction of the strut with the inner structural ring.
Figure 2:
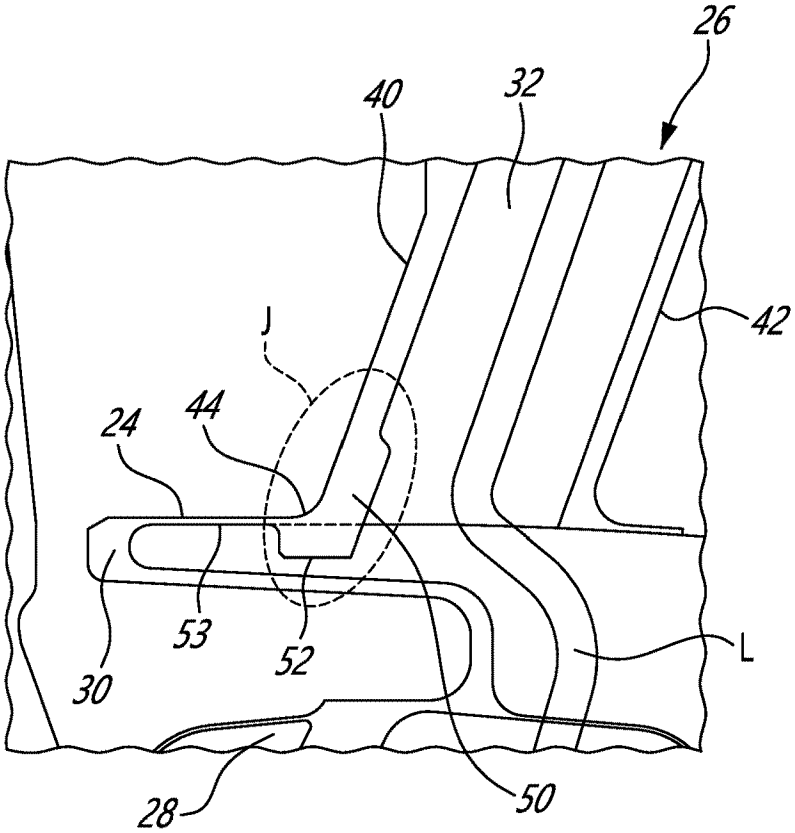
FIG. 2 is a schematic enlarged cross-section view of a radially inner end portion of an exhaust strut of a turbine exhaust case (TEC) of the engine shown in FIG. 1.
Figure 4:
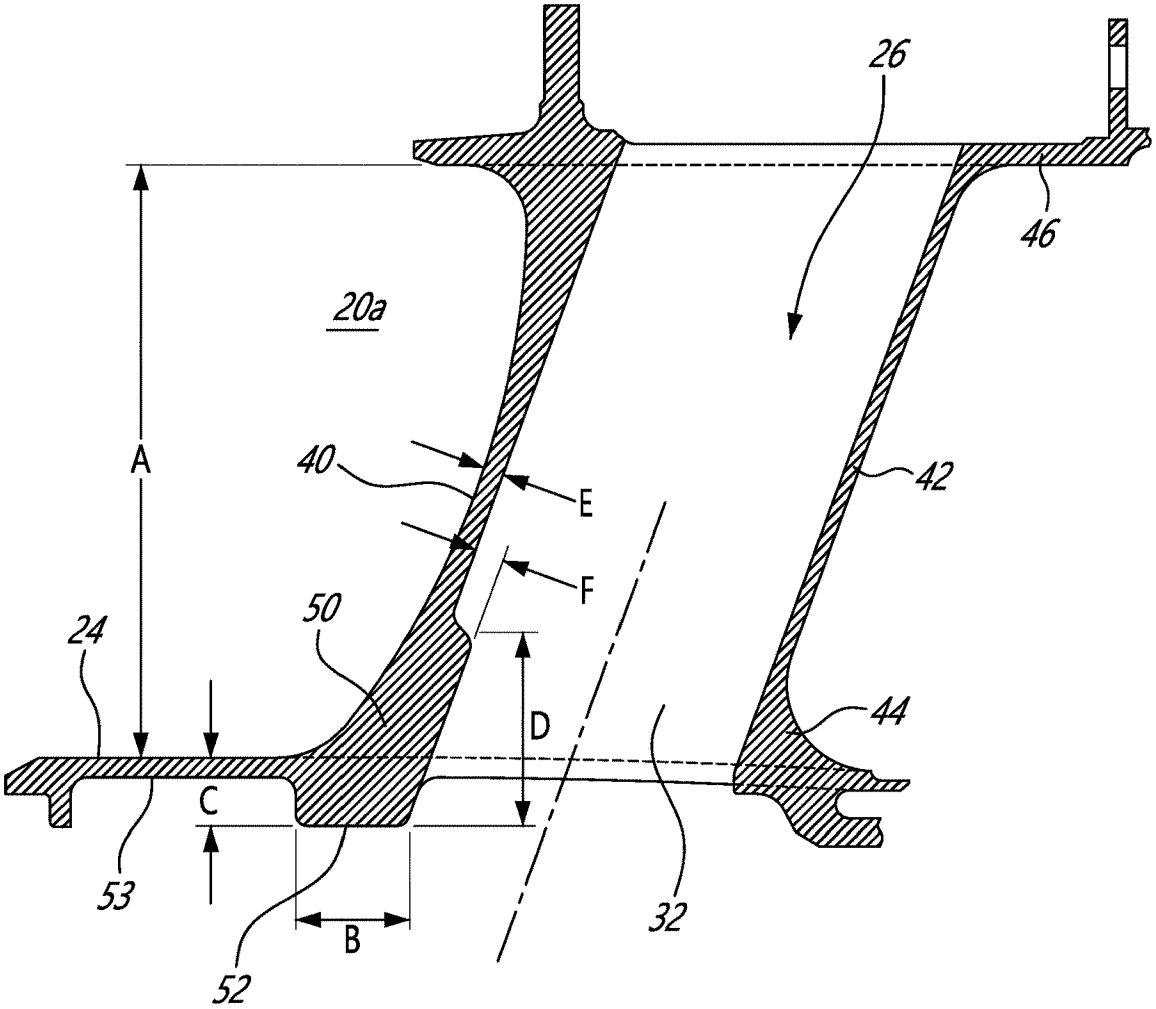
FIG. 4 is an enlarged cross-section of the radially inner end portion of the exhaust strut illustrating the merging of the strut reinforcement core structure with a stiffener ring projecting from a radially inner surface of the TEC inner ring.

Referring jointly to FIGS. 1-7, it can be appreciated that the exemplified struts 26 have an airfoil profile to serve as vanes for guiding the incoming flow of hot gases through the annular exhaust path 20*a*. According to the illustrated example, each of the struts 26 has an airfoil body with a hollow core 32, the airfoil body having opposed pressure and suction sides 36, 38 extending chordwise from a leading edge 40 to a trailing edge 42 and spanwise from a radially inner end 44 to a radially outer end 46 (FIGS. 1 and 4). As shown in FIG. 2, the hollow core 32 of the struts 26 may provide an internal passageway for service lines L and the like.

It has been found that in certain engine running conditions, the thermal differential growth between the struts 46 and the cases 22, 24 of the TEC may result in high stress concentration in the junction region J (FIG. 2) of the leading edge 40 of the struts 26 and the inner case 24. According to one aspect, the tensile stress in region J of the strut leading edge 40 can be reduced to an acceptable level by locally providing a leading edge stiffener 50 at the junction of the leading edge 40 with the inner case 24.

According to some embodiments, the leading edge stiffener 50 is provided in the form of an internal core structure at the radially inner end 44 of the leading edge 40 of the struts 26. The internal core structure is configured to locally reinforce the struts 26 where high stress concentrations have been observed. According to one aspect, the leading edge stiffener 50 is integrally cast with the associated strut 26 has an internal mass projecting into the hollow core 32 at the radially inner end 44 of the strut 26. Such an embedded cast structure allows to locally increasing the wall thickness of the leading edge 40 at the inner end 44 of the strut to reduce the stress concentration thereat.

As can be appreciated from FIGS. 2 to 7, the leading edge stiffener 50 projects radially inwardly beyond the airfoil body of the struts 26 to merge with a stiffener ring 52 projecting from a radially inner surface 53 of the inner case 24. As shown in FIG. 7, the stiffener ring 52 extends along a full circumference of the inner case 24 and the leading stiffeners 50 radiate from different circumferential locations around the stiffener ring 52 into respective hollow cores 32 of the struts 26. The leading edge stiffeners 50 of the struts 26 around the inner case 24 are, thus, structurally interconnected via the stiffener ring 52. As best shown in FIG. 4, the stiffener ring 52 is disposed to axially span the leading edge 40 of the airfoil body of the struts 26. The combination of the leading edge stiffeners 50 of the struts 26 with the stiffener ring 52 on the inner case 24 allows distributing the loads outside the struts 26, thereby relieving stress from the struts 26. For instance, the leading edge stiffeners 50 and the stiffener ring 52 can cooperate to remove tensile stress in the strut leading edge 40 when there is a high delta temperature between the struts 26 and cases 22, 24 of the TEC 15. According to another aspect, the leading edge stiffeners 50 and the stiffener ring 52 eliminate the need for a heavy structural inner ring, thereby providing weight savings.

Referring to FIG. 4, there is shown one possible configuration of the leading edge stiffener 50. According to this example, the leading edge stiffener 50 has a radial height (D) which is greater than or equal to one-third of the radial height (A) of the annular exhaust gas path 20*a*. According to another aspect, the stiffener ring 52 has a radial height (C) which is greater than or equal to two-thirds of its axial length (B). According to another aspect, the leading edge stiffener 50 projects into the hollow core 32 by a distance (F) which is greater than or equal to the thickness (E) of the leading edge wall of the strut 26 at an intermediate location generally midway between the outer and inner cases 22, 24. In other words, the leading edge stiffener 50 at least locally doubles the leading edge wall thickness of the airfoil body of the strut 26. According to another aspect, the axial length (B) of the stiffener ring 52 is greater than or equal to half the leading edge stiffener height (D). Various combinations of the above aspects are contemplated to reduce stress concentration at the leading edge of the struts 26.

From FIG. 3, it can be seen that the leading edge stiffener 50 has a width (W) in a circumferential direction. The width (W) generally corresponds to that of the leading edge 40. That is the leading edge stiffener 50 is comprised between the opposed sides 36, 38 of the airfoil body of the strut 26.

Figure 5:
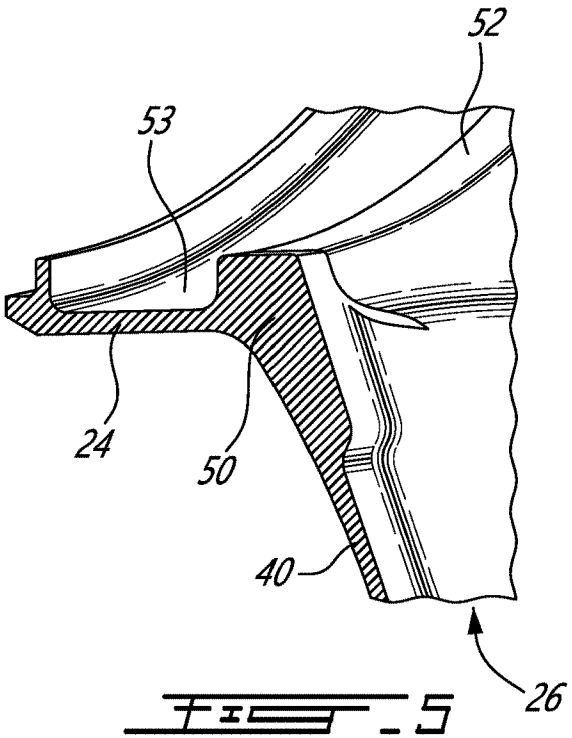
FIG. 5 is an isometric view illustrating the merging of the strut reinforcement core structure with the inner stiffener ring of the TEC inner ring.
Figure 6:
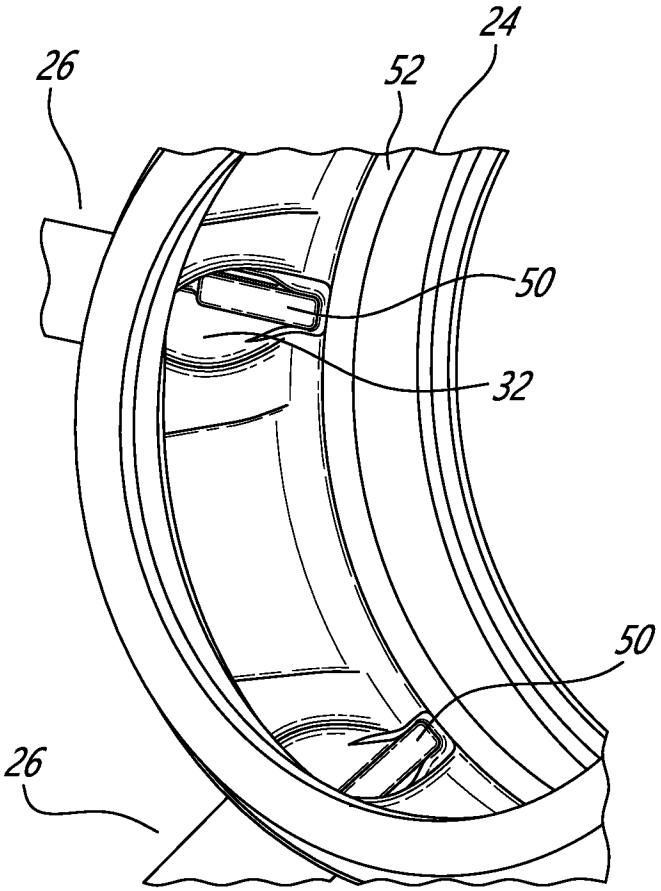
FIG. 6 is an isometric view of a sector of the TEC illustrating the strut reinforcement core structures inside two adjacent struts of the TEC.

Referring to FIGS. 3, 6 and 7, it can be seen that the leading edge stiffener 50 may have a generally rectangular face facing the interior of the hollow airfoil body of the strut. Also, as shown in FIGS. 4 and 5, the leading edge stiffener 50 may taper in a radially outward direction (that is in a direction away from the stiffener ring 52).

According to one aspect of some embodiments, the shape and position of the leading edge stiffener 50 inside the hollow core of the struts 26 is configured to act as a structural reinforcement which may on itself or in combination with the stiffener ring 52 be sufficient to allow the exhaust struts 26 to withstand the compressive stresses induced at the radially inner end portion of the strut leading edge when the strut are subject to thermal growth especially during engine transient conditions.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, not all of the struts may incorporate the leading edge stiffener. Indeed, the TEC may include more than one strut configuration. Also, while FIG. 1 illustrates a turboprop engine, it is understood that the TEC 15 could be integrated to other types of engines. It is also understood that features from different embodiments can be intermixed. Yet further modifications could be implemented by a person of ordinary skill in the art in view of the present disclosure, which modifications would be within the scope of the present technology.

The invention claimed is:

1. A turbine exhaust case (TEC) comprising:

an outer case;

an inner case having a radially outer surface and a radially inner surface opposite the radially outer surface;

an annular exhaust gas path between the outer case and the inner case, the radially outer surface of the inner case forming a radially inner boundary of the annular exhaust gas path; and a plurality of struts extending across the annular gas path and structurally connecting the inner case to the outer case, at least one of the plurality of struts having an airfoil body with a hollow core, the airfoil body having opposed sides extending chordwise from a leading edge to a trailing edge and spanwise from a radially inner end to a radially outer end;

wherein the at least one of the plurality of struts has a leading edge stiffener at the radially inner end thereof, the leading edge stiffener projecting into the hollow core and merging with a stiffener ring projecting from the radially inner surface of the inner case, the leading edge stiffener extending radially outwardly relative to the radially inner boundary of the annular exhaust gas path.

2. The TEC according to claim 1, wherein the annular exhaust gas path has a radial height (A) between the inner case and the outer case, wherein the leading edge stiffener has a radial height (D), and wherein (D)≥⅓×(A).

3. The TEC according to claim 1, wherein the stiffener ring has a radial height (C) and an axial length (B), and wherein (C)≥⅔×(B).

4. The TEC according to claim 1, wherein the leading edge stiffener at least locally doubles a leading edge wall thickness (E) of the airfoil body at the inner end of the at least one of the plurality of struts.

5. The TEC according to claim 1, wherein the leading edge stiffer has a width (W) in a circumferential direction, and wherein the width (W) corresponds to a dimension of the leading edge of the at least one of the plurality of struts in the circumferential direction between the opposed sides of the airfoil body.

6. The TEC according to claim 1, wherein the leading edge stiffener is integrally cast with the at least one of the plurality of struts as a localized internal wall reinforcing mass at the leading edge of the inner end of the airfoil body of the at least one of the plurality of struts.

7. A TEC comprising:

an outer case extending around a central axis;

an inner case concentrically disposed inside the outer case, the inner case having a radially inner surface and a radially outer surface opposite the radially inner surface, a stiffener ring projecting from the radially inner surface;

an annular exhaust gas path between the outer case and the inner case, the radially outer surface of the inner case defining an inner boundary of the annular exhaust gas path; and a plurality of struts extending across the annular exhaust path and structurally connecting the inner case to the outer case, the plurality of struts including at least one strut having an airfoil body with a hollow core, the airfoil body having opposed pressure and suction sides extending from a leading edge to a trailing edge, the at least one of the plurality of struts locally reinforced along a radially inner end portion of the leading edge by a leading edge stiffener projecting into the hollow core and merging with the stiffener ring on the radially inner surface of the inner case, the leading edge stiffener extending radially outwardly relative the inner boundary of the annular exhaust gas path.

8. The TEC according to claim 7, wherein the leading edge stiffener comprises a localized thickening of a leading edge wall of the airfoil body.

9. The TEC according to claim 7, wherein the annular exhaust gas path has a radial height (A) between the inner case and the outer case, wherein the leading edge stiffener has a radial height (D), and wherein (D)≥⅓×(A).

10. The TEC according to claim 7, wherein the stiffener ring has a radial height (C) and an axial length (B), and wherein (C)≥⅔×(B).

11. The TEC according to claim 8, wherein the localized thickening of the leading edge wall of the airfoil body provides a wall thickness at the radially inner end portion of the leading edge, which is at least twice that of an intermediate portion of the leading edge wall.

12. The TEC according to claim 7, wherein the leading edge stiffener is provided in the form of a generally rectangular mass of material projecting into the hollow core.

13. A TEC comprising:

an outer case extending around a central axis;

an inner case concentrically disposed inside the outer case, the outer case and the inner case defining therebetween an annular exhaust gas path, the inner case having a radially inner surface and a radially outer surface opposite to the radially inner surface, the radially outer surface forming an inner boundary of the annular exhaust gas path, the inner case further having a stiffener ring projecting from the radially inner surface; and a plurality of struts connecting the inner case to the outer case, each strut of the plurality of struts including:

a hollow airfoil body having opposed sides extending chordwise from a leading edge to a trailing edge, and a leading edge stiffener inside the hollow airfoil body at a junction of the leading edge and the inner case, the leading edge stiffener merging with the stiffener ring on the radially inner surface of the inner case and extending radially outwardly relative to the inner boundary of the annular exhaust gas path.

14. The TEC according to claim 13, wherein the stiffener ring extends circumferentially along a full circle, and wherein the leading edge stiffeners of the plurality of struts connect with the stiffener ring at circumferentially spaced-apart locations around the stiffener ring.

15. The TEC according to claim 14, wherein the stiffener ring axially spans the leading edges of the plurality of struts.

16. The TEC according to claim 15, wherein the stiffener ring and the leading edge stiffeners of the plurality of struts are integrally cast as a unitary body.

17. The TEC according to claim 14, wherein the inner case and the outer case define an annular exhaust gas path therebetween, the annular exhaust gas path having a radial height (A) between the inner case and the outer case, wherein the leading edge stiffener has a radial height (D), and wherein (D)≥⅓×(A).

18. The TEC according to claim 17, wherein the stiffener ring has an axial length (B), and wherein (B)≥½×(D).

* * * * *